US011261685B2

(12) United States Patent
Samuel

(10) Patent No.: US 11,261,685 B2
(45) Date of Patent: Mar. 1, 2022

(54) ADJUSTABLE MODULATED AGITATOR

(71) Applicant: Halliburton Energy Services, Inc., Houston, TX (US)

(72) Inventor: Robello Samuel, Cypress, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 16/482,901

(22) PCT Filed: Apr. 19, 2017

(86) PCT No.: PCT/US2017/028283

§ 371 (c)(1),
(2) Date: Aug. 1, 2019

(87) PCT Pub. No.: WO2018/194575

PCT Pub. Date: Oct. 25, 2018

(65) Prior Publication Data

US 2020/0011146 A1 Jan. 9, 2020

(51) Int. Cl.
*E21B 31/00* (2006.01)
*E21B 21/08* (2006.01)
*E21B 21/10* (2006.01)

(52) U.S. Cl.
CPC ..... *E21B 31/005* (2013.01); *E21B 21/08* (2013.01); *E21B 21/10* (2013.01)

(58) Field of Classification Search
CPC ..... E21B 33/005; E21B 28/00; E21B 28/08; E21B 28/10; E21B 7/24; E21B 31/005; E21B 21/08; E21B 21/10
See application file for complete search history.

(56) References Cited

U.S. PATENT DOCUMENTS

| | | | | |
|---|---|---|---|---|
| 4,890,682 | A | 1/1990 | Worrall et al. | |
| 2012/0048619 | A1 | 3/2012 | Seutter et al. | |
| 2014/0041943 | A1 | 2/2014 | Lanning et al. | |
| 2014/0151068 | A1 | 6/2014 | Gilleylen et al. | |
| 2014/0158426 | A1 | 6/2014 | Hay et al. | |
| 2015/0068811 | A1 * | 3/2015 | Marchand | E21B 4/02 175/107 |
| 2016/0115738 | A1 | 4/2016 | Samuel | |
| 2016/0195087 | A1 * | 7/2016 | Downton | F04C 15/0084 175/57 |

FOREIGN PATENT DOCUMENTS

| | | | | |
|---|---|---|---|---|
| WO | 2014099783 | A1 | 6/2014 | |
| WO | WO-2014189517 | A1 * | 11/2014 | E21B 4/02 |

* cited by examiner

*Primary Examiner* — Dany E Akakpo
(74) *Attorney, Agent, or Firm* — Benjamin Ford; Parker Justiss, P.C.

(57) ABSTRACT

This disclosure provides an agitator system that includes an agitator assembly of concentric power-sections, (one power-section inside another power-section both of which comprise stators and rotors). The agitator system includes a controller configured to control a valve assembly of the agitator assembly to selectively open and close the valve assembly to allow fluid to selectively flow between the power-sections of the agitator assembly that generates pressure fluctuations or pressure pluses in the fluid pressure, which increases the speed of the rotor or rotors, and thus, the vibrational frequency of the agitator. The controller can be used to increase the vibrational frequency of the agitator assembly when necessary to prevent the drill string from becoming lodged in a wellbore.

19 Claims, 5 Drawing Sheets

ADJUSTABLE MODULATED AGITATOR

CROSS-REFERENCE TO RELATED APPLICATION

This application is the National Stage of, and therefore claims the benefit of, International Application No. PCT/US2017/028283 filed on Apr. 19, 2017, entitled "ADJUSTABLE MODULATED AGITATOR," which was published in English under International Publication Number WO 2018/194575 on Oct. 25, 2018. The above application is commonly assigned with this National Stage application and is incorporated herein by reference in its entirety.

BACKGROUND

Some oil and gas wellbore profiles include a laterally extending ("horizontal") wellbore extending from a parent, or primary (vertical) wellbore, to increase the interface or surface area with the producing formation. As the length of the horizontal wellbore increases, friction or sticking force on a drill string being advanced within the horizontal wellbore increases. The friction is due to contact between the wall of the wellbore and drill string. As the length of the drill string increases, the portion of the drill string engaging the wall of the wellbore also increases, thus increasing the friction. The friction may also increase due to build-up of solid materials around the drill string.

Downhole pulse generating devices are sometimes coupled to the drill string to create fluctuations in fluid pressure that result in vibrating the drill string. The vibrations help maintain movement of the drill string, which is desirable during operation since the dynamic friction is substantially less than the static friction force. The vibrations also help prevent the build-up of solid materials around the drill string and prevent the drill string from becoming stuck in the well.

As the length of the drill string increases, a single pulse generating device may not be sufficient to minimize the friction, thus requiring multiple pulse generating devices to be coupled to the drill string. However, multiple pulse generating devices can result in sympathetic vibration assumed by the drill string, which can damage the drill string.

DETAILED DESCRIPTION

Figure 1:
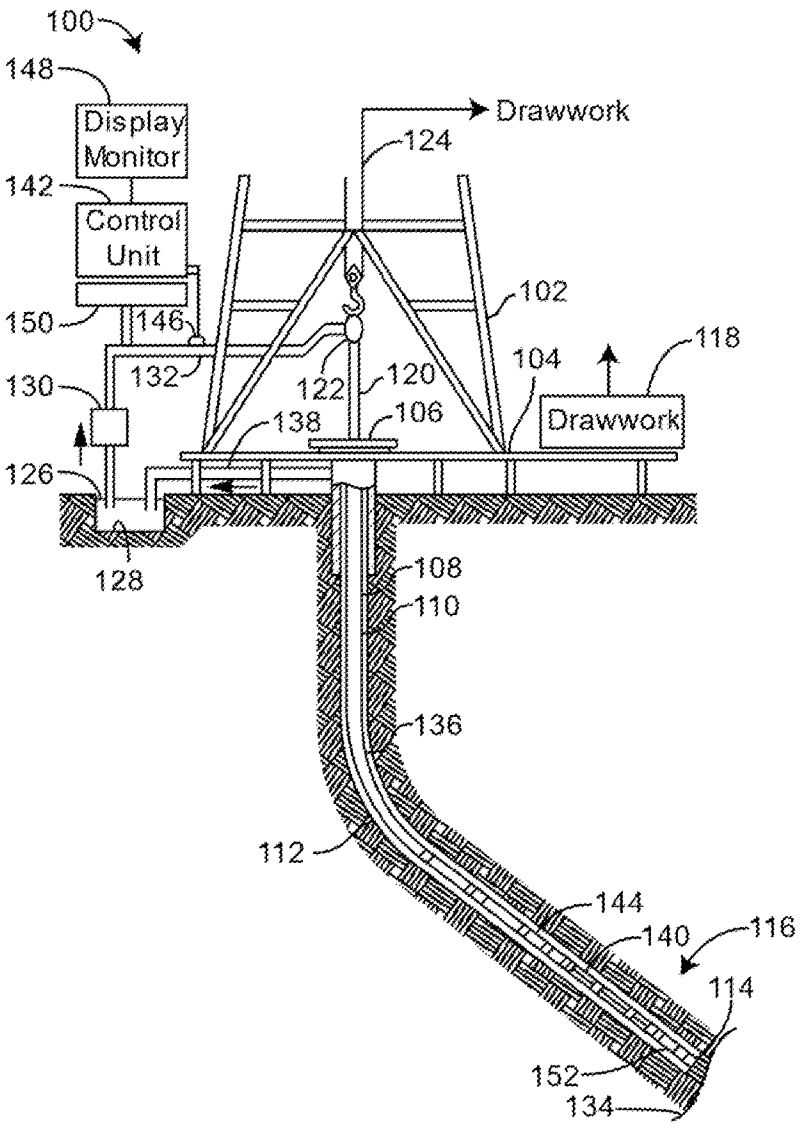
FIG. 1 illustrates a wellbore system and an agitator assembly, embodiment of which are provided herein.

This disclosure, in its various embodiments, provides an agitator system that includes an agitator assembly of concentric power-sections. An assembly of concentric power-sections is one power-section inside another power-section, where each comprise a stator and rotor. The agitator system includes an electrical controller configured to control a valve assembly of the agitator assembly to selectively open and close the valve assembly to allow fluid to flow in between the power-sections of the agitator assembly. The controller is configured to selectively direct fluid flow through the valve assembly and generate pressure fluctuations or pressure pulses in the fluid pressure, which increases the speed of the rotor or rotors, and thus, the vibrational frequency of the agitator. The frequency of the pressure pulses (and the resulting vibrations) generated by the agitator depends on the time interval between the shutting and opening of the valve assembly, as instructed by the controller. As such, the controller can be used to increase the vibrational frequency of the agitator assembly when necessary to prevent the drill string from becoming lodged in a wellbore.

In the drawings and descriptions that follow, like parts are typically marked throughout the specification and drawings with the same reference numerals, respectively. The drawn figures are not necessarily to scale. Certain features of this disclosure may be shown exaggerated in scale or in somewhat schematic form and some details of conventional elements may not be shown in the interest of clarity and conciseness. Specific embodiments are described in detail and are shown in the drawings; with the understanding that they serve as examples and that, they do not limit the disclosure to only the illustrated embodiments. Moreover, it is fully recognized that the different teachings of the embodiments discussed, below, may be employed separately or in any suitable combination to produce desired results.

A "wellbore" as used herein and in the claims, may be any type of wellbore that is associated with both production and non-production wellbores, including exploration wellbores or injection wellbores. Moreover, a wellbore is not limited to oil and gas wellbores, but include other types of wellbores used to recover various fluids, regardless of viscosity, from the earth.

The various characteristics mentioned above, as well as other features and characteristics described in more detail below, will be readily apparent to those skilled in the art with the aid of this disclosure upon reading the following detailed description of the embodiments, and by referring to the accompanying drawings.

FIG. 1 shows a schematic diagram of a drilling system 100 in which an agitator assembly 140 may be used according to aspects of the present disclosure. The schematic nature of this diagram is representative of any of a variety of different drilling system configurations. As shown, for example, the system 100 includes a derrick 102 that could be, among the various options, a derrick in the context of a land platform or a derrick in the context of a sea platform. The derrick 102 is erected on a derrick floor 104, which supports a rotary table 106 that may be rotated by a prime mover (not shown), or alternatively, by a top drive, at a desired rotational speed. A drill string 108 that comprises interconnected drill pipe sections (e.g., tubing segments or stands) 110 extends downward from rotary table 106 into a directional wellbore 112, which may follow a three-dimensional path. A drill bit 114 is attached to the downhole end of drill string 108 and disintegrates the geological formation 116 when drill bit 114 is rotated. The drill string 108 is coupled to a drawworks 118 via a kelly joint 120, swivel 122 and line 124 through a system of pulleys (not shown). During the drilling operations, drawworks 118 is operated to control the weight on bit 114 and the rate of penetration of drill string 108 into wellbore 112.

During drilling operations a suitable drilling suspension fluid (also referred to in the art as "mud") 126 from a mud pit 128 is circulated under pressure through drill string 108 by a mud pump 130. Drilling fluid 126 passes from mud pump 130 into drill string 108 via fluid line 132 and kelly joint 120. Drilling fluid 126 is discharged at the borehole bottom 134 through an opening in drill bit 114. Drilling fluid 126 circulates uphole through the annular space 136 between drill string 108 and wellbore 112 and is discharged into mud pit 128 via a return line 138. Preferably, a variety of sensors (not shown) are appropriately deployed on the surface according to any of a variety of methods in the art to provide information about various drilling-related parameters, such as fluid flow rate, weight on bit, hook load, etc.

The drilling system includes an agitator system that comprises an agitator assembly 140 coupled to the drill string 108 and comprises power modules as described below. The power modules are controlled by a surface controller 142, which form a portion of the agitator system, to open and close fluid valves within the agitator assembly 140 to adjust a flow through the power modules and thereby control the vibrational frequency as needed during drilling to prevent the drill string 108 from becoming stuck in the wellbore 112.

Vibrational sensors 144 in the agitator assembly 140 are configured to detect vibrations within the drill string 108 and transmit those signals uphole to the controller 142. The above-noted sensors may transmit data to the vibrational sensors 144, which in turn transmits the vibrational data uphole to the control unit 142. In one embodiment a mud pulse telemetry technique may be used to communicate data from the vibrational sensors 144 and other telemetry sensors during drilling operations. A transducer 146 placed in the mud supply line 132 detects the mud pulses responsive to the data transmitted by the vibrational sensor 144. Transducer 146 generates electrical signals in response to the mud pressure variations and transmits such signals to the surface control unit 142. The surface control unit 142 processes such signals according to programmed instructions stored in a memory, or other data storage unit, in data communication with surface control unit 142. The control unit 142 may display desired drilling parameters and other information on a display/monitor 148 which may be used by an operator to control the drilling operations. The control unit 142, which is described in more detail below, may contain a computer, a memory for storing data, a data recorder, and other peripherals. Control unit 146 may also have drilling, log interpretation, and directional models stored therein and may process data according to programmed instructions, and respond to user commands entered through a suitable input device, such as a keyboard (not shown).

In other embodiments, other telemetry techniques such as electromagnetic and/or acoustic techniques, or any other suitable technique known in the art may be utilized to transmit the vibrational data transmitted by the vibrational sensors 144. In one embodiment, hard-wired drill pipe may be used to communicate between the surface and downhole devices. In one example, combinations of the techniques described may be used. In one embodiment, a surface transmitter receiver 150 communicates with downhole tools using any of the transmission techniques described, for example a mud pulse telemetry technique. This may enable two-way communication between control unit 142 and the agitator assembly 140, embodiments of which are described below.

In one embodiment, a downhole drilling motor 152 is included in drill string 108. Downhole drilling motor 152 may be a fluid driven, progressive cavity drilling motor of the Moineau type that uses drilling fluid to rotate an output shaft that is operatively coupled to drill bit 114. In some embodiments, the rotation of bit 114 may be the combination of rotation of drill string 108 and the rotation of a motor shaft that is coupled to the agitator assembly 140.

Figure 2:
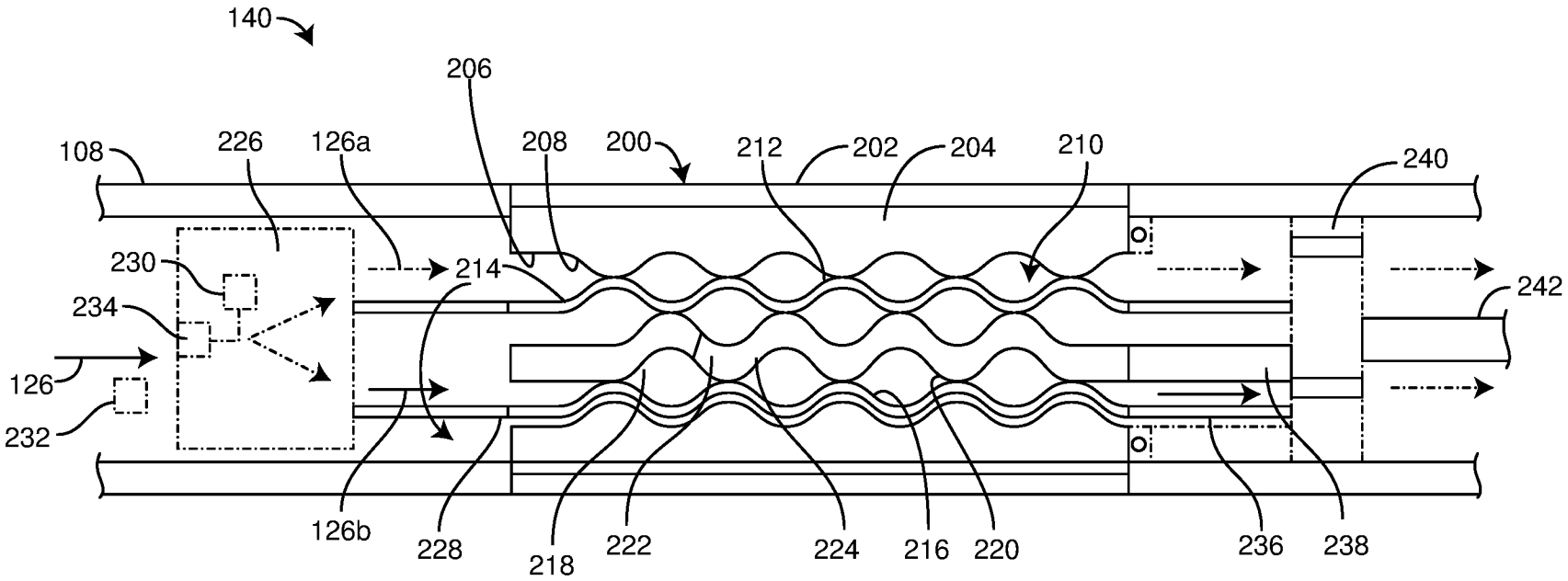
FIG. 2 illustrates an embodiment of an agitator assembly

FIG. 2 illustrates one embodiment of the agitator assembly 140, as generally described above. In the illustrated embodiment, the agitator assembly 140 comprises a power section 200 that provides at least two different concentric stator/rotor combinations. Though only two stator/rotor combinations are illustrated, other embodiments provide for more than two concentric stator/rotor combinations, for example, in one embodiment, there may be as many as 9 concentric stator/rotor combinations within the agitator assembly 140. A housing 202 is connected to the drill string 108. An elastomeric helically shaped first stator 204 is adhered to the inner surface of housing 202. Stator 204 has a inner helically shaped first cavity 206 with a first number N1 of first stator lobes 208 formed along the first cavity 206. A helically shaped, shaft 210 is positioned in the first cavity 206. Shaft 210 may be formed from conventional materials, such as a metallic material, for example, steel, stainless steel, nickel based alloys, aluminum, and titanium. The shaft 210 has a second number N2 of first rotor lobes 212 on an outer surface thereof that form a first rotor 214, where in some embodiments, N2 may be equal to N1−1. There is an interference seal (not shown) between the first stator lobes 208 and the first rotor lobes 212. The first stator lobes 208 and the first rotor 214 form a first vibrational power module of the agitator assembly 140.

When drilling fluid 126*a* flows through the passages between the first stator lobes 208 and the first rotor lobes 212, first rotor 214 is forced to rotate relative to first stator 204, which has rotational speed associated and a corresponding vibrational frequency associated therewith.

A helically shaped elastomer second stator 216 is located on an inner surface of the first stator 204, where, in one embodiment, the second stator 216 has a third number N3 of second stator lobes 220 where N3 is the same as the number of lobes N2 of the first rotor 214. Similarly, there is a second helically shaped rotor 222 positioned between the shaft 210 and the second stator 216 that form a second flow cavity 218. In one embodiment, the second rotor 222 has a fourth number N4 of second rotor lobes 224 where N4=N3−1. There is an interference seal (not shown) between the second stator lobes 220 of the second stator 216 and the second rotor lobes 224 of the second rotor 222. When drilling fluid 126*b* flows through the passages between the second stator 216 and the second rotor 222, the second rotor 222 is forced to rotate relative to second stator 216. The second stator 216 and the second rotor 222 for a second vibrational power module of the agitator assembly 140. The second rotor 222 may also be formed from conventional materials, such as a metallic material, for example, steel, stainless steel, nickel based alloys, aluminum, and titanium.

Drilling fluid 126 may be diverted to one of: a first flow cavity 206 located between the first stator 204 and the shaft 210, a second flow cavity 218 located between the second rotor 222 and the second stator 215, or both the first flow cavity 206 and second flow cavity 218 simultaneously, by a valve assembly 226 in the upstream flow passage. Shaft 210 has a flexible conduit 228 that extends form the end of shaft 210 to the valve assembly 226. The flexible conduit 228 may be coupled to the valve assembly 226 by a rotating fluid coupling (not shown). This allows conduit 228 to rotate with shaft 210 while maintaining a flow separation between the first flow cavity 206 and the second flow cavity 218, when desired. A sub-controller 230, which is coupled to the controller 142, may be operably connected to the valve assembly 226 to control the flow selection. In one embodiment, sub-controller 230 may receive instructions from the controller 142 via telemetry from the surface as described above. In another embodiment, sub-controller 230 may receive instructions via a flowable device, for example a radio frequency identification device (RFID) 232 that is inserted in the flow stream. RFID 232 may contain instructions that are transmitted to RFID receiver 234 operably connected to sub-controller 230. Valve assembly 226 may be of conventional design. For example, the valve assembly may be a conventional axial valve, a radial valve, or any other conventional valve configuration. Also, the valve assembly 226 may comprise a internal flow channeling through the use of conventional sliding sleeves and/or actuatable valve elements to suitably divert the fluid flow, as directed by the controller 142. This capability provides for a wider range of vibrational frequencies over a wider range of fluid flow rates than would not be possible with a single configuration agitator. In one embodiment, flexible shafts 236 and 238 couple first rotor 214 and second rotor 222 respectively through a controllable clutch 240, as a dog clutch, to an output shaft 242.

The valve assembly 226 may be selectively opened and shut to allow fluid 126 to flow between the above-described stators and rotors of the agitator assembly 140. By selectively allowing fluid 126 flow through valve assembly 226, pressure fluctuations or pressure pulses in the fluid pressure are generated in the agitator assembly 140, which creates vibrations in the agitator assembly 140. The frequency of the pressure pulses (and the resulting vibrations) generated by the agitator assembly 140 may be dependent on the time interval between the shutting and opening of the valve assembly 226. The vibrations create movement in the drill string 108 as operatively coupled to the agitator assembly 140, and thereby, reduce the friction experienced by the drill string 108, which causes the drill string 108 to be conveyed through the wellbore 112 more easily. It should be noted that the disclosure may refer to the "frequency of the pressure pulses or vibrations generated by the agitator assembly 140" as the "frequency of the agitator assembly 140." Both instances refer to the same thing and therefore may be used interchangeably throughout this disclosure.

Figure 3A:
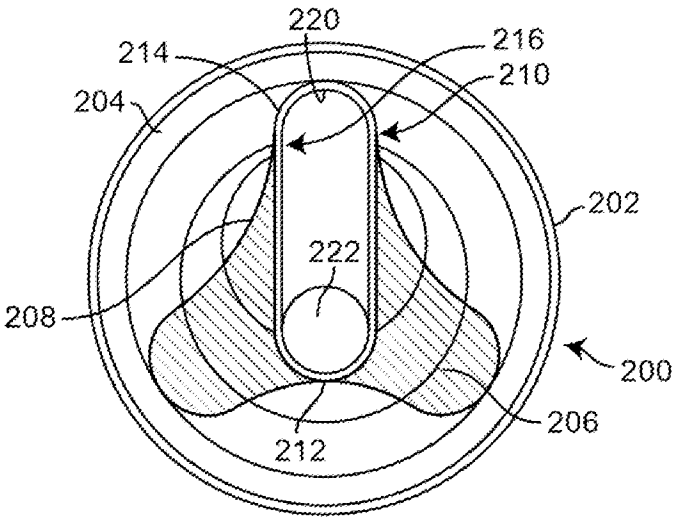
FIG. 3A illustrates a sectional view of one embodiment of a stator/rotor combination in a first open position.
Figure 3B:
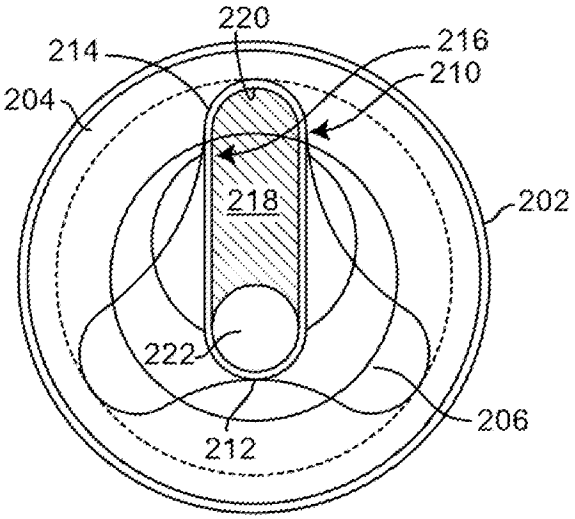
FIG. 3B illustrates a sectional view of one embodiment of a stator/rotor combination in a second open position.

FIGS. 3A and 3B show axial, sectional views of the agitator assembly 140 with the fluid flowing through the first flow cavity 206 and the second flow cavity 218, as controlled by the valve assembly 226 and the controller 142, as discussed above. FIG. 3A demonstrates flow through the first flow cavity 206. In this embodiment, the first stator 204 has three lobes 208, and the first rotor 260 has two lobes 225. When directed by the controller 142 through the valve assembly 226, fluid flows only through first flow cavity 206, and first rotor 214 rotates with respect to first stator 204 at a rotational speed of RPM1. In FIG. 3B, the second rotor 222 has a single lobe while second stator 216 has 2 lobes. When directed by the controller 142 through the valve assembly 226, the fluid flows only through second flow cavity 218, and only the second rotor 222 rotates with respect to the second stator 216 at a rotational speed RPM2. The second stator 216 does not rotate with respect to housing 202. When the annular gap between the three lobe configuration 208 is closed, the two lobe configuration 216 is open. This enables the two lobe configuration 216 to operate. When the second flow cavity 218 is closed, the first flow cavity 206 is open so that the fluid can pass through the first flow cavity 206, enabling the three lobe power section. When fluid flows through both flow cavities 206, 218 each rotor 214, 222 rotates with respect to its respective stator 204, 216. This causes rotor 222 to rotate at an additive speed of RPM3=RPM1+RPM2. The increase rotations increases the vibrational frequency of the agitator assembly 140. Thus, if the drill string 108 rotates at $N_s$ rpm, the new speed combination is:

$$N_{inner} = N_s + \sum^{m} N_{n-1}\left[\frac{n}{1+n}\right],$$

where n is the number of lobes, thus the frequency increases based on the following equation:

$$f_{Hz} = \left(N_s + \sum^{m} N_{n-1}\left[\frac{n}{1+n}\right]\right)/60$$

By selectively controlling the fluid flow 126 through the valve assembly 226, and thus the above-described stators and rotors, pressure fluctuations or pressure pulses (and the resulting vibrations) generated by the agitator assembly 140 are controlled by the shutting and opening of the valve assembly 226, as controlled by the controller 142.

Figure 3C:
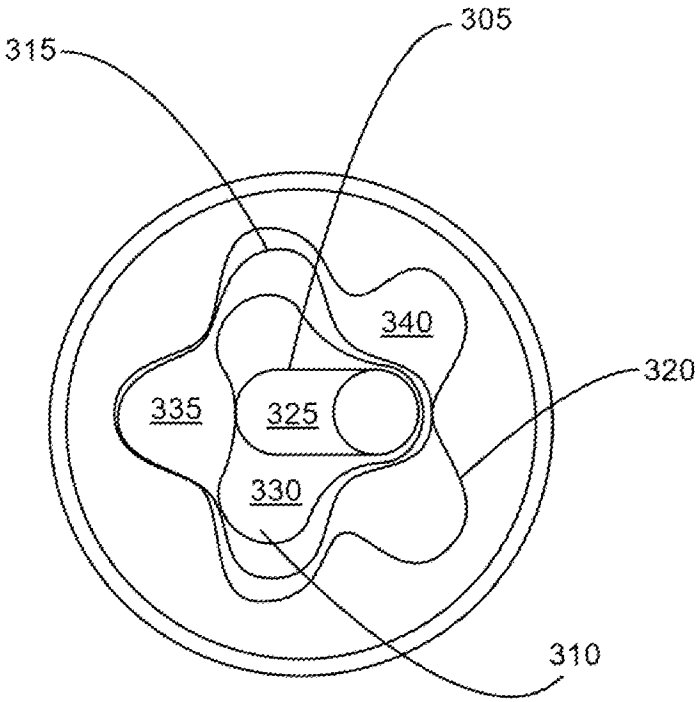
FIG. 3C illustrates a sectional view of another embodiment of multiple stator/rotor combinations.

In various embodiments, the frequency can be increased as follows: from about 15 to about 20 HZ for two lobe power section, from about 25 to about 30 HZ for 2 inside 3 lobe power section, from about 32 to about 37 HZ for 2 inside 3 inside 4 power section, from about 37 to about 42 HZ for 2 inside 3 inside 4 inside 5 power section, any combination of which results in increased vibrational frequency, as instructed by the controller 142. An embodiment of the last configuration just mentioned above is shown in FIG. 3C. FIG, 3C illustrates a 2 lobe power section 305, inside a 3 lobe power section 310, inside a 4 lobe power section 315, inside a 5 lobe power section 320 and having flow cavities 325, 330, 335, and 340, as generally shown.

Figure 4:
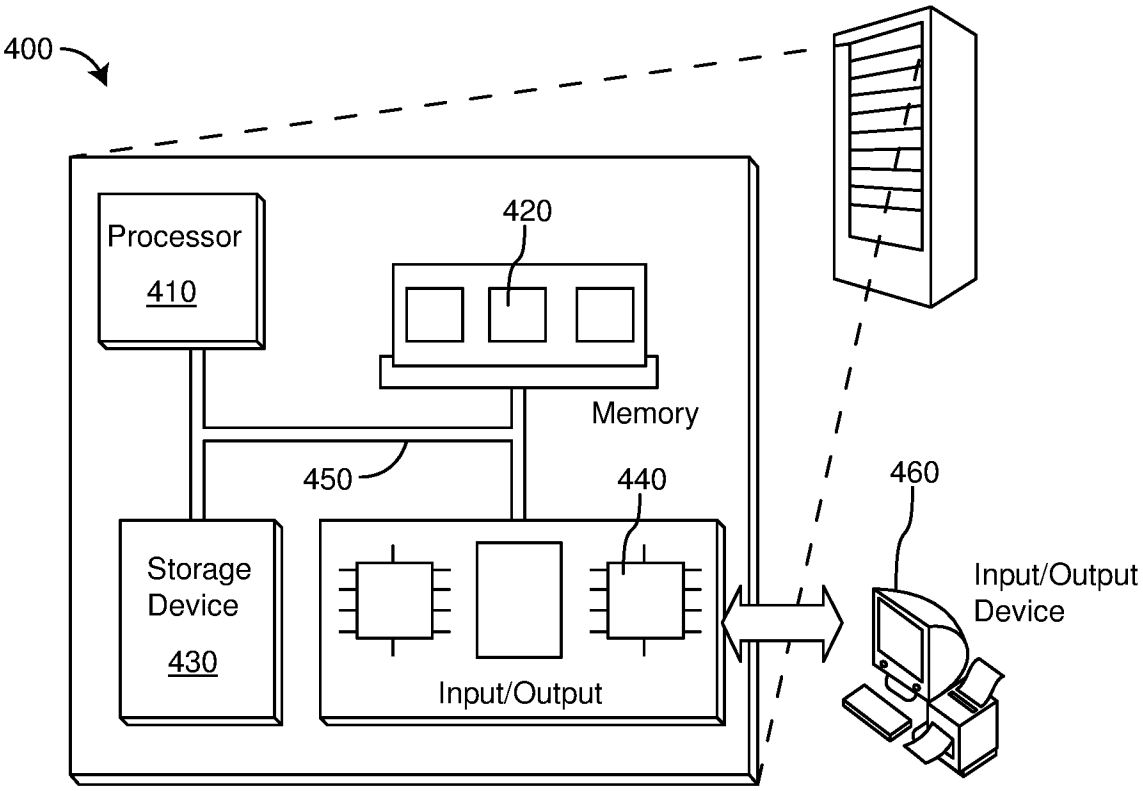
FIG. 4 illustrates an embodiment of a controller that can be used to control a valve assembly of the agitator to increase a vibrational frequency of the agitator.

FIG. 4 illustrates an embodiment of a computer system 400 that can function as the controller 142 for controlling the vibrational frequency of the agitator assembly 140, as discussed above. The computer system 400 may be located at a wellsite or may be located at a remote location from the wellsite, and able to receive input data and provide processed results via wired or wireless telecommunication methods. In an embodiment, the computer system 400 may be provided with input data including, but not limited to, the frequency of the agitator assembly 140 coupled to the drill string 108, the location of each agitator, where multiple agitators are present, the length (and other physical properties) of the drill string 108, the structure and composition of the wellbore 112 and the surrounding formation, and the like.

The computer system 400 may include a processor 410, computer-readable storage media such as memory 420 and a storage device 430, and an input/output device 440. Each of the components 410, 420, 430, and 440 may be interconnected, for example, using a system bus 450. The processor 410 may process instructions for execution within the computer system 400. In some embodiments, the processor 410 is a single-threaded processor, a multi-threaded processor, a system on a chip, a special purpose logic circuitry, e.g., an FPGA (field programmable gate array) or an ASIC (application specific integrated circuit), or another type of processor. The processor 410 may be execute a computer readable program code stored in the memory 420 or on the storage device 430. The memory 420 and the storage device 430 include non-transitory media such as random access memory (RAM) devices, read only memory (ROM) devices, optical devices (e.g., CDs or DVDs), semiconductor memory devices (e.g., EPROM, EEPROM, flash memory devices, and others), magnetic disks (e.g., internal hard disks, removable disks, and others), and magneto-optical disks.

The input/output device 440 may perform input/output operations for providing the above-mentioned input data to the computer system 400. The computer system 400 may process the input data and provide the processing results using the input/output device 440. For example, the processing results may include the natural frequency of the drill string 108, energy distribution in the drill string 108 and the agitator assembly 140, and/or an indication whether the vibrational frequency criterion based on the energy distribution is satisfied. Based on the results, the fluid flow may be adjusted to increase the vibrational frequency by using the valve assembly as discussed above such that the energy distribution criterion is satisfied.

In some embodiments, the input/output device 440 can include one or more network interface devices, e.g., an Ethernet card; a serial communication device, e.g., an RS-232 port; and/or a wireless interface device, e.g., an 802.11 card, a 3G wireless modem, or a 4G wireless modem. In some embodiments, the input/output device 440 can include driver devices configured to receive input data and send output data to other input/output devices 460 including, for example, a keyboard, a pointing device (e.g., a mouse, a trackball, a tablet, a touch sensitive screen, or another type of pointing device), a printer, and display devices (e.g., a monitor, or another type of display device) for displaying information to a user. Other kinds of devices can be used to provide for interaction with the user as well; for example, feedback provided to the user can be any form of sensory feedback, e.g., visual feedback, auditory feedback, or tactile feedback; and input from the user can be received in any form, including acoustic, speech, or tactile input. In some embodiments, mobile computing devices, mobile communication devices, and other devices can be used.

The computer system 400 may include a single processing system, or may be a part of multiple processing systems that operate in proximity or generally remote from each other and typically interact through a communication network. Examples of communication networks include a local area network ("LAN") and a wide area network ("WAN"), an inter-network (e.g., the Internet), a network comprising a satellite link, and peer-to-peer networks (e.g., ad hoc peer-to-peer networks). A relationship of client and server may arise by virtue of computer programs running on the respective processing systems and having a client-server relationship to each other.

In one embodiment of operation, the controller 142 receives signals from downhole sensors, as discussed above, that provide data to the controller 142 to allow it to determine if the downhole progression of the drill string 108 is proceeding in accordance with specified drilling criteria. If the controller 142 determines that the drill string's downhole progression is not proceeding according to required drilling criteria, that is, there may be an indication that the drill string 108 is getting or is stuck, the controller 142 sends a single to the valve 226 of the agitator assembly 140 to increase fluid flow through one or more of the agitator's power modules, which increases rotation speed and thus, the vibrational frequency. When more than one agitator assembly 140 is included in the drill string 108, the controller 142 will monitor each agitator assembly 140 in a similar fashion. In one embodiment, the communications between the controller 142 and the agitator assembly 140 is constant so that the controller 142 can respond quickly to a change in the downhole progression of the drill string 108. In one embodiment, when the controller 142 determines that the downhole progression meets drilling criteria, the controller 142 may send a signal to the valve 226 to cause it to reduce the rotational speed of the power modules of the agitator assembly 140, or discontinue the rotational speed completely, which reduces or ceases the vibrations of the agitator assembly 140. In another embodiment, however, the controller 142 by cause the agitator assembly 140 to constantly vibrate to make sure that the drill string 108 does not become stuck. This may particularly be the case, when the direction of the wellbore 112 is substantially horizontal.

Figure 5:
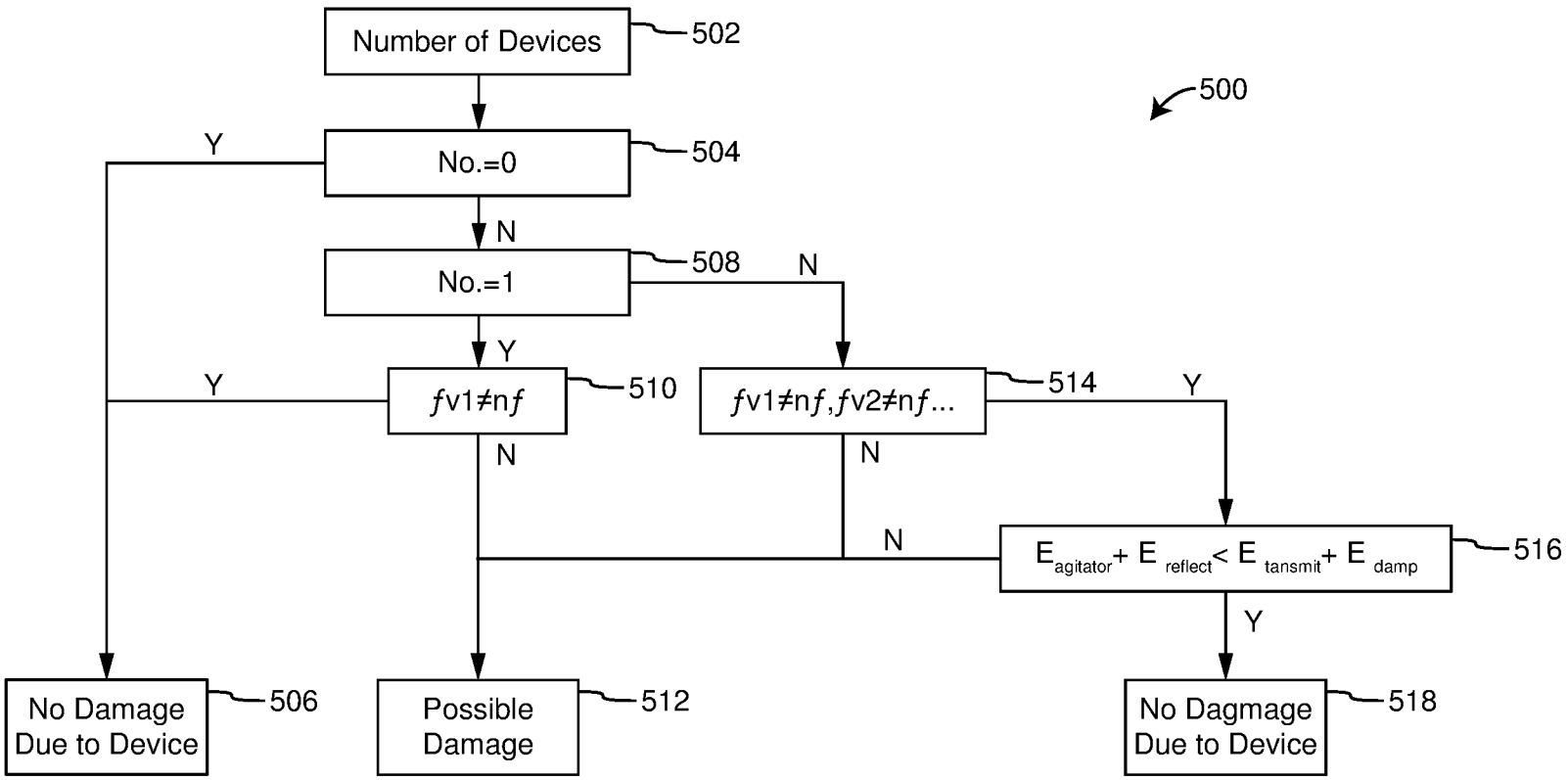
FIG. 5 illustrates a flow chart of an embodiment of a method of predicting damage to a wellbore drill string due to multiple agitator assemblies coupled thereto.

In certain embodiments, more than one agitator assembly 140 may be present in the drill string. In such embodiments, the agitators 140 may be spaced apart along a predetermined length of the drill string. FIG. 5 illustrates a flow chart of one embodiment of a method 500 of predicting damage to a wellbore drill string due to multiple agitator assemblies coupled thereto. The method 500 begins by determining the number of agitator assemblies coupled to the drill string, as at 502. Specifically, the method determines the number of agitator assemblies that are coupled to portion of the drill string that will be advanced through a horizontal portion of a wellbore.

If the number of agitator assemblies is determined to be zero, as at 504, then there will be no damage to the drill string caused by the agitator assemblies, as indicated at 506. If the number of agitator assemblies is determined to be non-zero at 504, the method then checks whether a single agitator assembly is coupled to the drill string, as at 508. If only one agitator assembly is present, the method compares the frequency of the agitator assembly (or, more specifically, the frequency of the vibrations generated by the agitator assembly) with the natural frequency of the drill string, as at 510. The natural frequency of the drill string is the frequency that the drill string has as the result of the rotation of the drill string itself. If the frequency of the agitator assembly is not equal to the natural frequency of the drill string, then it is determined that there may be no damage to the drill string, as at 506. If the frequency of the agitator assembly is equal to the natural frequency of the drill string, then it may be concluded that the drill string may incur potential damage due to the agitator assembly, as at 512, if the condition continues. Remedial measures may be undertaken to minimize the possibility of damage to the drill string by changing the vibration frequency of one or more of the agitator assemblies. For instance, the wellbore operator or drilling technician may adjust the frequency of the agitator assembly, by using the controller, such that the resulting frequency is different from the natural frequency of the drill string, or may use a different agitator assembly having a frequency different from the natural frequency of the drill string.

If at 508 it is determined that multiple (more than one) agitator assemblies are present, then the frequency of each agitator assembly is compared with the natural frequency of the drill string, as at 514. If the frequency of at least one agitator assembly is determined to be equal to the natural frequency of the drill string, then it may be determined that the vibrations due to the at least one agitator assembly may potentially damage the drill string, as at 512. Remedial measures may be then undertaken to minimize the possibility of damage to the drill string. For instance, the wellbore operator or drilling technician may adjust the frequency of the agitator assembly(s) having a frequency equal to the natural frequency of the drill string such that the resulting frequency is different from the natural frequency of the drill string. Alternatively, the wellbore operator or drilling technician may use different agitator assembly(s) having a frequency different from the natural frequency of the drill string.

If each agitator assembly is determined to have a frequency different from the natural frequency of the drill string, then the method 500 may calculate the energy distribution due to the multiple agitator assemblies, as at 516. For instance, the energy distribution may be calculated based on the energy distribution criterion of Equation (1) above. If the energy distribution criterion is satisfied, it may be concluded that there may be no damage to the drill string, as at 518. Otherwise, it may be concluded that the drill string may potentially be damaged, as at 512.

Remedial measures may be undertaken to minimize the possibility of damage to the drill string when the energy distribution criterion is not satisfied. For instance, the remedial measures may include changing the location of the agitator assemblies on the drill string. As mentioned above, this is an iterative process that is performed until the energy distribution criterion is satisfied.

Numerous other modifications, equivalents, and alternatives, will become apparent to those skilled in the art once the above disclosure is fully appreciated. It is intended that the following claims be interpreted to embrace all such modifications, equivalents, and alternatives where applicable.

Embodiments herein comprise:

An agitator system that comprises an agitator assembly having a housing and including stators and rotors located therein that form at least two concentric power modules having at least first and second flow cavities located therethrough. A valve assembly is fluidly connected to the at least two concentric power modules. The valve assembly is configured to selectively control a flow of drilling fluid through the at least two concentric power modules. A controller is coupled to the valve assembly and one or more downhole sensors. The controller is configured to receive signals from the one or more downhole sensors that send downhole drilling data to the controller. The controller is further configured to send control signals to the valve assembly to open and close the valve assembly to increase a rotational speed of at least one of the at least two concentric power modules and control a vibrational frequency of the at least two concentric power modules.

Another embodiment is directed to a method of vibrating a drilling string, comprising: sending drilling data from a downhole sensor to a controller that indicates a drilling progression of a drill string; determining, by the controller, if the drilling data is within specified drilling progression criteria; sending a control signal from the controller to a valve assembly of an agitator assembly to open or close valves of the valve assembly when the specified drilling progression criteria is not met; and selectively controlling a flow of drilling fluid through the valve assembly based on the control signal to control a flow of a drilling fluid through a flow cavity of at least two concentric power modules of the agitator assembly to increase a rotational speed and a vibration frequency of the agitator assembly until the drilling progression criteria is met.

Another embodiment is directed to A computer program product embodied in a non-transitory computer-readable medium and comprising a computer readable program code that, when executed by a computer system, causes the computer system to: send drilling data from a downhole sensor to a controller that indicates a drilling progression of a drill string; determine if the drilling data is within specified drilling progression criteria; send a control signal from the controller to a valve assembly of an agitator assembly to open or close valves of the valve assembly when the specified drilling progression criteria is not met; and selectively control a flow of drilling fluid through the valve assembly based on the control signal to control a flow of a drilling fluid through a flow cavity of at least two concentric power modules of the agitator assembly to increase a rotational speed and a vibration frequency of the agitator assembly until the drilling progression criteria is met.

Each of the foregoing embodiments may comprise one or more of the following additional elements singly or in combination, and neither the example embodiments or the following listed elements limit the disclosure, but are provided as examples of the various embodiments covered by the disclosure:

Element 1: wherein the controller is configured to send a control signal to the valve assembly to divert drilling fluid to one of: a first flow cavity of the at least the first and second flow cavities, a second flow cavity of the at least the first and second flow cavities, or both the first flow cavity and second flow cavity simultaneously of the agitator assembly.

Element 2: further comprising a sub-controller coupled to the controller and coupled to the valve assembly and configured to control the drilling fluid flow selection.

Element 3: wherein the controller is configured to increase a rotational speed of at least one of the at least two concentric power modules and control a vibrational frequency of the at least two concentric power modules in response to the downhole drilling data.

Element 4: wherein the controller is configured to predict damage to a wellbore drill string due one or more agitator assemblies being coupled thereto by sensing the natural vibrating frequency of the drill string and adjusting the vibrational frequency of one or more of the agitator assemblies in response to the vibrational frequency of one or more of the agitator assemblies.

Element 5: wherein the at least two concentric power modules comprises a two lobe power section, a two lobe power section inside a 3 lobe power section, a 2 lobe power section inside a 3 lobe power section, inside a 4 lobe power section, or a 2 lobe power section inside a 3 lobe power section, inside a 4 lobe power section, inside a 5 lobe power section.

Element 6: wherein the controller if configured to increase the two lobe power section from about 15 HZ to about 20 HZ, increase the 2 lobe power section inside the 3 lobe power section from about 25 HZ to about 30 HZ, increase the 2 lobe power section inside the 3 lobe power section, inside the 4 lobe power section from about 32 HZ to about 37 HZ, or increase the 2 lobe power section inside the 3 lobe power section, inside the 4 lobe power section, inside the 5 lobe power section from about 37 HZ to about 42 HZ.

Element 7: wherein the controller is a computer that is provided with input data including, a frequency of the agitator assembly coupled to a drill string, a location of the agitator assembly, physical properties of the drill string, a structure and composition of a wellbore, or surrounding geological formation of the wellbore.

Element 8: wherein the controller sends a signal to the valve assembly to cause the valve assembly to reduce the rotational speed of the at least two concentric power modules or discontinue the rotational speed when the controller receives data that a drilling progression criteria is met.

Element 9: wherein the controller is configured to cause the agitator assembly to constantly vibrate during a drilling process.

Element 10: wherein sending the control signal includes sending a signal to the valve assembly to divert drilling fluid to one of: a first flow cavity of the at least two concentric power modules, a second flow cavity of the at least two concentric power modules, or both the first flow cavity and second flow cavity simultaneously of the agitator assembly.

Element 11: wherein sending drilling data includes predicting damage to a wellbore drill string due one or more agitator assemblies being coupled thereto by sensing the natural vibrating frequency of the drill string and adjusting the vibrational frequency of one or more of the agitator assemblies.

Element 12: wherein selectively controlling the flow of drilling fluid through the valve assembly includes channeling the drilling fluid through the use of sliding sleeves or actuatable valve elements of an axial valve or radial valve, as instructed by the controller.

Element 13: wherein the controller is configured to increase a vibrational frequency of a two lobe power section of the agitator assembly from about 15 HZ to about 20 HZ, increase the vibrational frequency of a 2 lobe power section inside a 3 lobe power section of the agitator assembly from about 25 HZ to about 30 HZ, increase a vibrational frequency of a 2 lobe power section inside a 3 lobe power section, inside a 4 lobe power section of the agitator assembly from about 32 HZ to about 37 HZ, or increase a vibrational frequency of a 2 lobe power section inside a 3 lobe power section, inside a 4 lobe power section, inside a 5 lobe power section of the agitator assembly from about 37 HZ to about 42 HZ.

Element 14: wherein the controller is a computer and sending drilling data includes providing the computer with input data including, a frequency of the agitator assembly coupled to a drill string, a location of the agitator assembly, physical properties of the drill string, a structure and composition of a wellbore, or surrounding geological formation of the wellbore.

Element 15: wherein the controller sends a signal to the valve assembly to cause the valve assembly to reduce the rotational speed of the at least two concentric power modules or discontinue the rotational speed when the controller receives data that a drilling progression criteria is met.

Element 16: wherein executing the program code further causes the computer system to send a signal to the valve assembly to divert drilling fluid to one of: a first flow cavity of the at least two concentric power modules, a second flow cavity of the at least two concentric power modules, or both the first flow cavity and second flow cavity simultaneously of the agitator assembly.

Element 17: wherein executing the program code further causes the computer system to increase a vibrational frequency of a two lobe power section of the agitator assembly from about 15 HZ to about 20 HZ, increase the vibrational frequency of a 2 lobe power section inside a 3 lobe power section of the agitator assembly from about 25 HZ to about 30 HZ, increase a vibrational frequency of a 2 lobe power section inside a 3 lobe power section, inside a 4 lobe power section of the agitator assembly from about 32 HZ to about 37 HZ, or increase a vibrational frequency of a 2 lobe power section inside a 3 lobe power section, inside a 4 lobe power section, inside a 5 lobe power section of the agitator assembly from about 37 HZ to about 42 HZ.

What is claimed is:

1. An agitator system, comprising:

an agitator assembly having a housing and including stators and rotors located therein that form at least two concentric power modules having at least first and second flow cavities located therethrough;

a valve assembly fluidly connected to the at least two concentric power modules, the valve assembly configured to selectively control a flow of drilling fluid through the at least two concentric power modules; and a controller coupled to the valve assembly and one or more downhole sensors, the controller configured to receive signals from the one or more downhole sensors that send downhole drilling data to the controller, the controller further configured to send control signals to the valve assembly to open and close the valve assembly to increase a rotational speed of at least one of the at least two concentric power modules and control a vibrational frequency of the at least two concentric power modules, wherein the controller is configured to predict damage to a wellbore drill string due to the agitator assembly being coupled thereto by sensing the natural vibrating frequency of the drill string and adjusting the vibrational frequency of the agitator assembly in response to the vibrational frequency of the agitator assembly.

2. The agitator system of claim 1, wherein the controller is configured to send a control signal to the valve assembly to divert drilling fluid to one of: a first flow cavity of the at least first and second flow cavities, a second flow cavity of at the least first and second flow cavities, or both the first flow cavity and second flow cavity simultaneously of the agitator assembly.

3. The agitator system of claim 1, further comprising a sub-controller coupled to the controller and coupled to the valve assembly and configured to control the drilling fluid flow selection.

4. The agitator system of claim 1, wherein the controller is configured to increase a rotational speed of at least one of the at least two concentric power modules and control a vibrational frequency of the at least two concentric power modules in response to the downhole drilling data.

5. The agitator system of claim 1, wherein the at least two concentric power modules comprises:

a two lobe power section; or a two lobe power section inside a three lobe power section; or a two lobe power section inside a three lobe power section, and inside a 4 lobe power section; or a two lobe power section inside a thee lobe power section, inside a four lobe power section, and inside a five lobe power section.

6. The agitator system of claim 5, wherein the controller is configured to:

increase the two lobe power section from about 15 HZ to about 20 HZ; or increase the two lobe power section inside the three lobe power section from about 25 HZ to about 30 HZ; or increase the two lobe power section inside the three lobe power section, and inside the four lobe power section from about 32 HZ to about 37 HZ; or increase the two lobe power section inside the three lobe power section, inside the four lobe power section, and inside the five lobe power section from about 37 HZ to about 42 HZ.

7. The agitator system of claim 1, wherein the controller is a computer that is provided with input data including, a frequency of the agitator assembly coupled to the drill string, a location of the agitator assembly, physical properties of the drill string, a structure and composition of a wellbore, or surrounding geological formation of the wellbore.

8. The agitator system of claim 1, wherein the controller sends a signal to the valve assembly to cause the valve assembly to reduce the rotational speed of the at least two concentric power modules or discontinue the rotational speed when the controller receives data that a drilling progression criteria is met.

9. The agitator system of claim 1, wherein the controller is configured to cause the agitator assembly to constantly vibrate during a drilling process.

10. A method of vibrating a drilling string, comprising:

sending drilling data from a downhole sensor to a controller that indicates a drilling progression of a drill string;

determining, by the controller, if the drilling data is within specified drilling progression criteria;

sending a control signal from the controller to a valve assembly of an agitator assembly to open or close valves of the valve assembly when the specified drilling progression criteria is not met; and selectively controlling a first flow of drilling fluid through the valve assembly based on the control signal to control a second flow of a drilling fluid through a flow cavity of at least two concentric power modules of the agitator assembly to increase a rotational speed and a vibrational frequency of the agitator assembly until the drilling progression criteria is met.

11. The method of claim 10, wherein the flow cavity is a first flow cavity of the at least two concentric power modules and a second flow cavity of the at least two concentric power modules, and wherein sending the control signal includes sending a signal to the valve assembly to divert drilling fluid to one of: the first flow cavity of the at least two concentric power modules, the second flow cavity of the at least two concentric power modules, or both the first flow cavity and second flow cavity simultaneously of the agitator assembly.

12. The method of claim 10, wherein sending drilling data includes predicting damage to the drill string due to the agitator assembly being coupled thereto by sensing the natural vibrating frequency of the drill string and adjusting the vibrational frequency of the agitator assemblies.

13. The method of claim 10, wherein selectively controlling the first flow of drilling fluid through the valve assembly includes channeling the drilling fluid through the use of sliding sleeves or actuatable valve elements of an axial valve or radial valve, as instructed by the controller.

14. The method of claim 10, wherein the controller is configured to:

increase a vibrational frequency of a two lobe power section of the agitator assembly from about 15 HZ to about 20 HZ; or increase a vibrational frequency of a two lobe power section inside a three lobe power section of the agitator assembly from about 25 HZ to about 30 HZ; or increase a vibrational frequency of a two lobe power section inside a three lobe power section, and inside a four lobe power section of the agitator assembly from about 32 HZ to about 37 HZ; or increase a vibrational frequency of a two lobe power section inside a three lobe power section, inside a four lobe power section, and inside a five lobe power section of the agitator assembly from about 37 HZ to about 42 HZ.

15. The method of claim 10, wherein the controller is a computer and sending drilling data includes providing the computer with input data including, the vibrational frequency of the agitator assembly coupled to the drill string, a location of the agitator assembly, physical properties of the drill string, a structure and composition of a wellbore, or surrounding geological formation of the wellbore.

16. The method of claim 10, wherein the controller sends a signal to the valve assembly to cause the valve assembly to reduce the rotational speed of the at least two concentric power modules or discontinue the rotational speed when the controller receives data that the drilling progression criteria is met.

17. A computer program product embodied in a non-transitory computer-readable medium and comprising a computer readable program code that, when executed by a computer system, causes the computer system to:

send drilling data from a downhole sensor to a controller that indicates a drilling progression of a drill string;

determine if the drilling data is within specified drilling progression criteria;

send a control signal from the controller to a valve assembly of an agitator assembly to open or close valves of the valve assembly when the specified drilling progression criteria is not met; and selectively control a first flow of drilling fluid through the valve assembly based on the control signal to control a second flow of a drilling fluid through a flow cavity of at least two concentric power modules of the agitator assembly to increase a rotational speed and a vibration frequency of the agitator assembly until the drilling progression criteria is met.

18. The computer program of claim 17, wherein the flow cavity is a first flow cavity of the at least two concentric power modules and a second flow cavity of the at least two concentric power modules, and further wherein executing the program code further causes the computer system to send the control signal to the valve assembly to divert drilling fluid to one of:

the first flow cavity of the at least two concentric power modules, the second flow cavity of the at least two concentric power modules, or both the first flow cavity and second flow cavity simultaneously of the agitator assembly.

19. The computer program of claim 17, wherein executing the program code further causes the computer system to increase a vibrational frequency of:

a two lobe power section of the agitator assembly from about 15 HZ to about 20 HZ; or increase a vibrational frequency of a two lobe power section inside a three lobe power section of the agitator assembly from about 25 HZ to about 30 HZ; or increase a vibrational frequency of a two lobe power section inside a three lobe power section, and inside a four lobe power section of the agitator assembly from about 32 HZ to about 37 HZ; or or increase a vibrational frequency of a two lobe power section inside a three lobe power section, inside a four lobe power section, and inside a five lobe power section of the agitator assembly from about 37 HZ to about 42 HZ.

* * * * *